United States Patent [19]

Burton

[11] Patent Number: 4,679,800

[45] Date of Patent: Jul. 14, 1987

[54] HAWSER CHAIN SEAL ASSEMBLY

[75] Inventor: James A. Burton, Houston, Tex.

[73] Assignee: Hydril Company, Los Angeles, Calif.

[21] Appl. No.: 660,710

[22] Filed: Oct. 15, 1984

[51] Int. Cl.[4] ..... B63B 21/18; F16J 15/00

[52] U.S. Cl. ..... 277/34; 24/116 R; 114/180; 114/200; 138/93; 277/188 A; 277/235 R

[58] Field of Search ..... 277/34, 34.3, 34.6, 277/1, 235 R; 166/354, 243, 84, 378, 379, 382, 385, 387, 355, 356, 82; 114/180, 179, 200; 285/97, 96, 363, 368, 412, 302, 347, 416; 138/93; 24/116 R; 16/2; 251/5

[56] References Cited

U.S. PATENT DOCUMENTS

| | | | |
|---|---|---|---|
| 293,610 | 2/1884 | Winter | 114/180 |
| 672,475 | 4/1901 | Cavallaro | 285/97 X |
| 1,861,726 | 6/1932 | Trout | 277/28 |
| 2,652,018 | 9/1953 | Griffith | 114/180 |
| 2,716,575 | 8/1955 | Vickers | 251/5 X |
| 2,871,035 | 1/1959 | Kaiser | 285/363 X |
| 2,994,291 | 8/1961 | Angell | 114/180 X |
| 3,001,804 | 9/1961 | Tomlinson et al. | 285/302 X |
| 3,038,022 | 6/1962 | Scott | 285/96 X |
| 3,039,795 | 6/1962 | Reuter | 285/363 X |
| 3,399,548 | 9/1968 | Burns | 285/302 X |
| 3,661,112 | 5/1972 | Angell | 114/180 X |
| 3,967,572 | 7/1976 | Lea | 114/200 X |
| 4,310,139 | 1/1982 | Williams, III et al. | 251/5 X |
| 4,322,054 | 3/1982 | Campbell | 251/5 |
| 4,330,143 | 5/1982 | Reneau | 285/347 X |
| 4,345,735 | 8/1982 | Regan | 277/34.3 X |
| 4,372,528 | 2/1983 | Raftis | 251/5 X |
| 4,567,840 | 2/1986 | Arlt et al. | 24/116 R X |

FOREIGN PATENT DOCUMENTS

| | | | |
|---|---|---|---|
| 48211 | 11/1982 | Japan | 114/180 |

*Primary Examiner*—Allan N. Shoap

*Attorney, Agent, or Firm*—Dodge, Bush & Moseley

[57] ABSTRACT

A hawser chain assembly and method for installation of its sealing element is disclosed. The assembly includes a housing adapted for connection in series with a hawser pipe of a marine vessel such as a semi-submersible drilling rig. The housing may be moved to an open position for installation or replacement of the sealing element, and a closed position to longitudinally surround and secure the sealing element. The sealing element has at least two semi-cylindrical elastomeric parts, each of which is adapted for placement partially about the hawser chain when the housing is in the open position. Each semi-cylindrical part has at least one inflatable bladder. A manifold is provided by which fluid pressure may be introduced to the bladders of the sealing element causing them to expand. The sealing element is restricted on its outer diameter by the closed housing causing the elastomeric material to move inwardly forming a sealing engagement with the chain.

7 Claims, 10 Drawing Figures

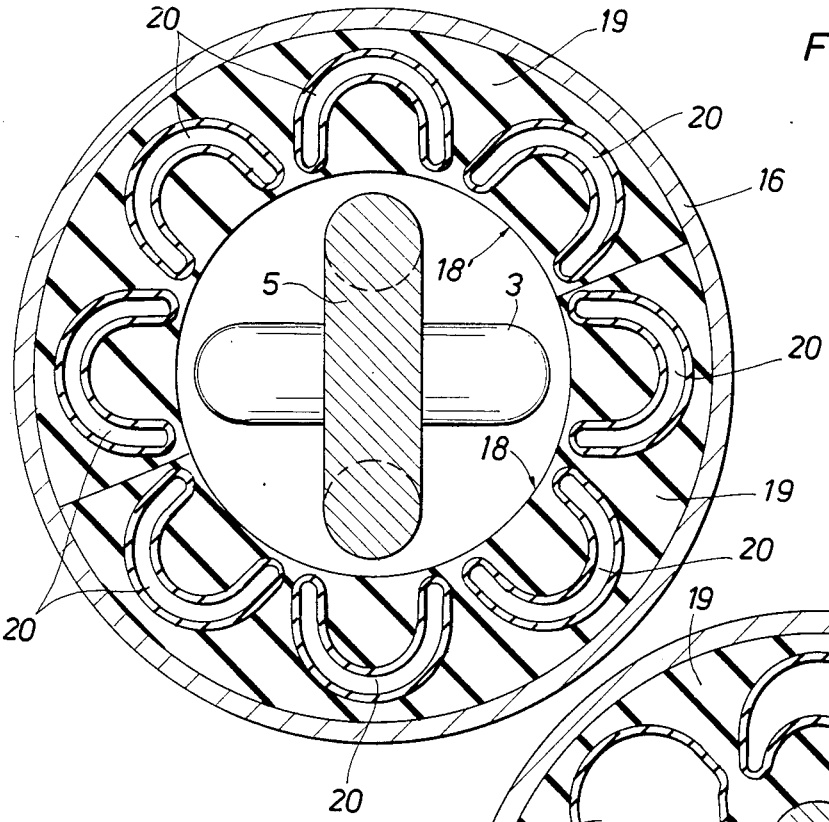
FIG. 4
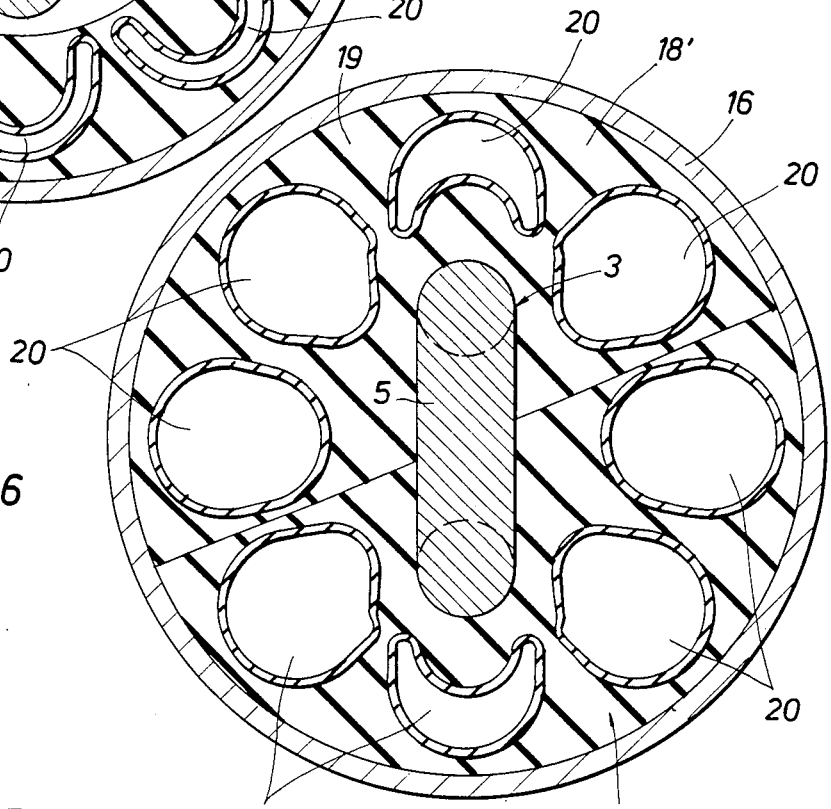
FIG. 6
FIG. 7A
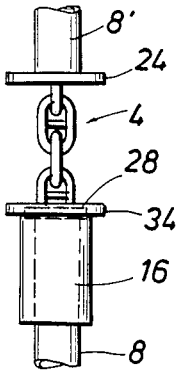
FIG. 7B
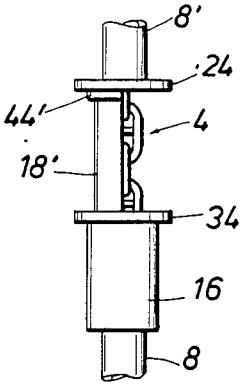
FIG. 7C
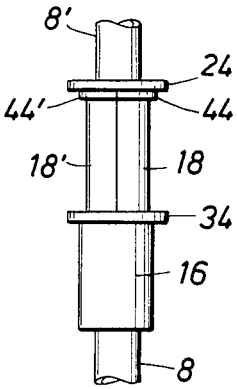
FIG. 7D
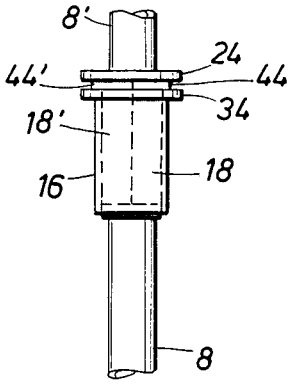

HAWSER CHAIN SEAL ASSEMBLY

BACKGROUND OF THE INVENTION

1. Field of the Invention

This invention relates in general to the field of closing devices useful in preventing water from passing to the chain locker via the hawse pipe of a marine vessel. Specifically the invention relates to a sealing device, which when installed in the hawse or chain pipe leading to the chain locker of a drilling vessel, will seal about the chain to prevent flooding of the chain locker during extreme list or storm weather conditions.

2. Description of the Prior Art

The prior art has provided both horizontal and vertical arrangements for the hawse pipe leading to the chain locker of a semi-submersible rig. Where the winch is located in the chain locker below the main deck, the top of the platform is left relatively clear and the overall center of gravity of the rig is advantageously lowered. If the hawse pipe is horizontally oriented, the hawse pipe opening may be low in relation to the water but, the rig may be susceptible to flooding during extreme list conditions or heavy weather.

In the vertical arrangement of the hawse pipe, a deck sheave and an underwater fairlead direct the anchor chain from an anchor to the vertical hawser pipe leading to the chain locker. Even with the vertically oriented hawser pipe, the chain locker is a potential rig destabilizing problem if it were to fill with water during extreme list conditions or heavy weather.

The prior art has not been able to solve the problem of providing a reliable sealing device to seal about the hawser or anchor chain and prevent seawater from flowing to the chain locker from the hawse pipe.

Prior art attempts to seal between the hawse pipe and the hawser chain have been unsuccessful due to the inability to position the chain relative to a ram-type closing device and due to the inability of other types of closing devices to conform to the highly irregular profile of a chain.

Identification of Objects of the Invention

It is therefore an object of this invention to provide a sealing device which reliably seals between the hawser chain and the hawser pipe operably preventing seawater from entering the chain locker via a hawse pipe during list or heavy weather conditions encountered by the vessel.

It is another object of the invention to provide a method for installation and/or a replacement of the packing element in the seal assembly without cutting or removing the hawser chain.

It is another object of the invention to provide a method for installing a replaceable sealing element in a hawser seal assembly while the hawser chain remains in place.

SUMMARY OF THE INVENTION

According to the invention, a hawser chain seal assembly is provided which is adapted for sealing about a hawser chain in a hawser pipe of an offshore drilling vessel. The assembly includes a housing which may be connected in series with the hawse pipe and is adapted for alternative placement in an open position for exposing the hawser chain extending through the hawser pipe or in a closed position for longitudinal surrounding the hawser chain. The sealing assembly includes a sealing element having at least two semi-cylindrical parts, each of the parts being adapted for placement partially about the hawser chain when the housing means is in the open position. The sealing element is longitudinally disposed about and between the hawser chain and the housing means when the housing is in the closed position.

The semi-cylindrical parts of the sealing element each have at least one inflatable bladder. The sealing element includes rings one each being attached to the top of the two semi-cylindrical parts of the sealing element for receiving pressurized fluid for application to the bladders of the sealing element to cause the sealing element to sealingly engage the hawser chain.

According to the invention, the housing is adapted to be connected between ends of two axially aligned sections of hawser pipe. A first outward flange is fastened to an end of a first section of a hawser pipe and a second outward flange is fastened to an end section of an aligned second hawser pipe. A sealing means is disposed peripherally about an outwardly facing surface of the second flange. A cylindrical housing structure is provided for sealingly engaging the sealing means of the second flange and for fastening to the first outward flange. The cylindrical housing structure may move in one direction to an open position for providing external access to the hawser chain and may move in the other direction to a closed position for fastening to the first outward flange. The sealing means is preferably an "O" ring disposed in a peripheral groove about the outwardly facing surface of the second flange. The cylindrical housing structure includes an outwardly facing flange which may be secured to the first outward flange by means of bolts through aligned holes.

The semi-cylindrical sealing parts of the sealing element are each formed of elastomeric material in the shape of one-half of a cylinder cut by a plane through its longitudinal axis. When placed about the hawser chain, the two semi-cylindrical sealing parts cooperate to form a cylindrical packer for sealing about the hawser chain. A plurality of inflatable bladders are preferably molded in each of the one-half cylindrical parts. Each one-half cylinder of elastomeric material further includes a ring of one-half toroidal shape secured to its top end. The rings have a plurality of holes provided therein, where each one of the holes communicates solely with one of the bladders in each one-half cylinder to which it is secured. The rings have an outer radius greater than the outer radius of the assembled one-half cylinder creating an outer flange extending beyond the cylindrical walls of the elastomeric material. The outer flange of the rings is clamped between the outwardly facing flange of the cylindrical housing structure and the first outward flange fastened to the hawser pipe when the cylindrical housing structure flange is fastened to the first outward flange. A manifold is provided in the first outward flange and provides fluid communication via the holes in the rings with each of the bladders and two one-half cylinders.

According to a preferred embodiment of the sealing element, the cross-sectional shape of the bladder is of the shape of a horseshoe facing the center line of the element.

The sealing element is installed about a hawser chain by moving the housing to the open position in order to expose the hawser chain. One semi-cylindrical part is placed about the hawser chain and then the other semi-cylindrical part is placed about the hawser chain until the two semi-cylindrical parts cooperate to form a cylindrical sealing element. The housing is then moved to the closed position thereby operably enclosing the cylindrical sealing element.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown of which:

FIG. 4 shows a cross-section taken through lines 4—4 of FIG. 3 and illustrates the sealing element in an open position with the hawse chain running through the seal assembly;

FIG. 6 illustrates in a cross-section taken through line 6—6 of FIG. 5, the seal assembly with its sealing element closed about a link of the hawse chain running through the hawse pipe;

FIGS. 7A, 7B, 7C, 7D show the procedure by which the sealing element is replaced or installed in the hawser chain seal assembly about the hawser chain running through the hawse pipe.

DESCRIPTION OF THE INVENTION

Figure 1:
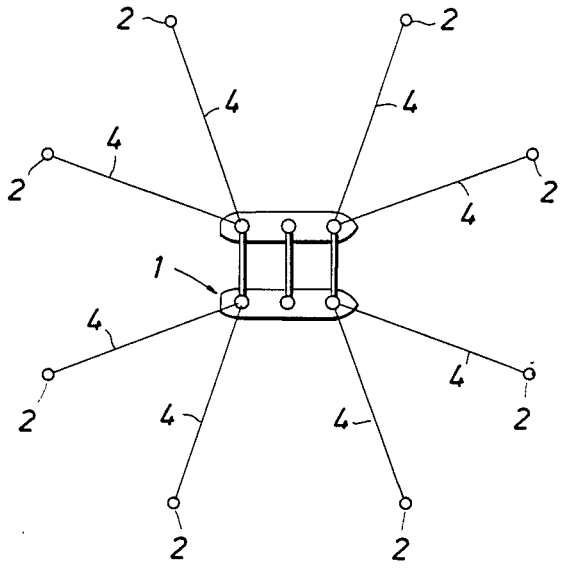
FIG. 1 shows a mooring plan of a drilling vessel, especially a semi-submersible drilling vessel, in which a number of anchors are secured by a means of anchor or hawse chains.

FIG. 1 illustrates a drilling vessel 1, especially a semi-submersible drilling rig. The rig is secured at a drilling location by means of a plurality of hawser or anchor chains 4 secured to the ocean floor by means of anchors 2.

Figure 2:
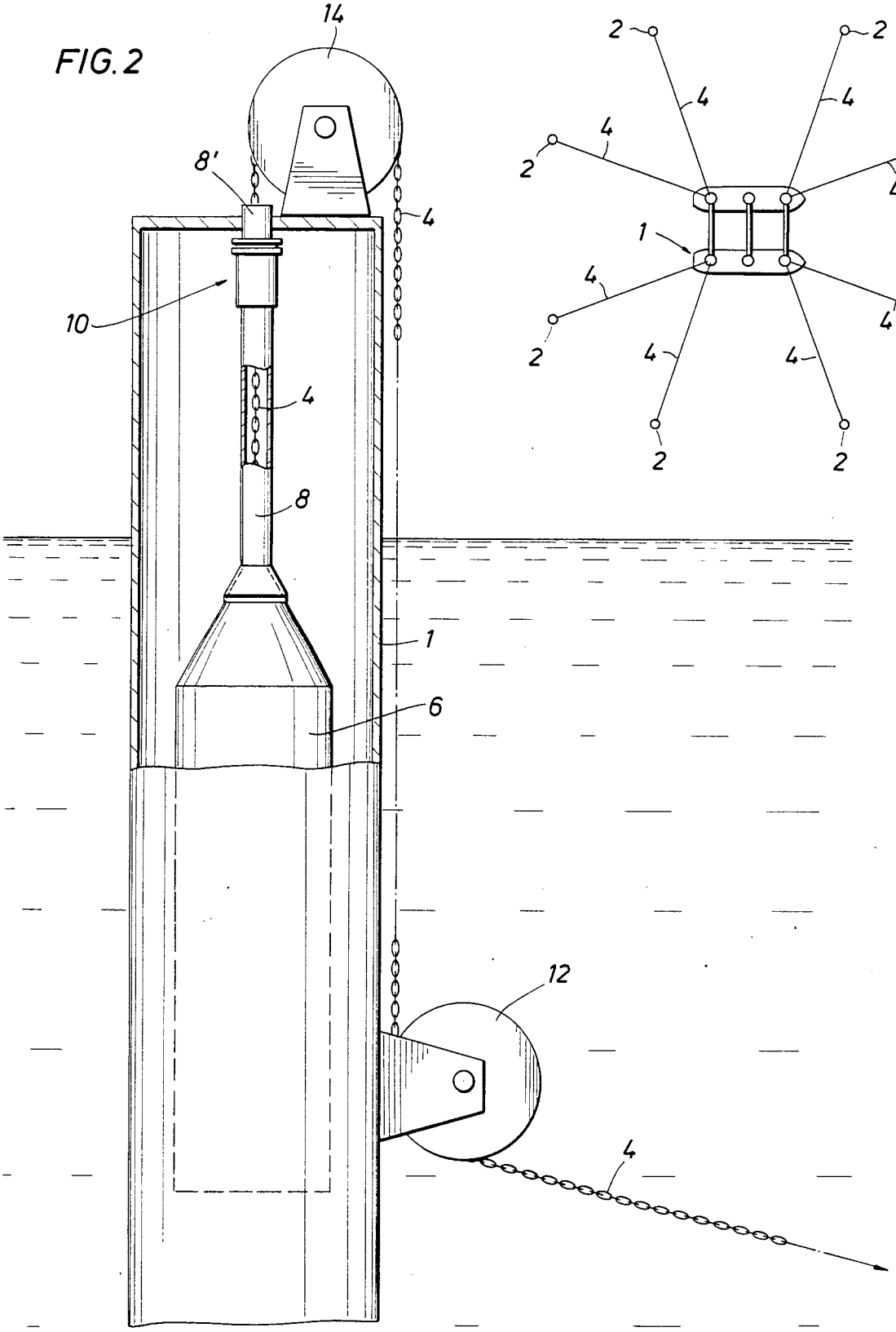
FIG. 2 illustrates in a schematic drawing, partially in cross-section and partially cut away, a vertically disposed chain locker of a semi-submersible vessel illustrating a chain locker and a hawse pipe with a hawse chain running therethrough about a deck sheave and an underwater fairlead to an anchor and showing the placement of a hawser chain seal assembly according to the invention.

FIG. 2 illustrates one of the chain lockers to which the hawser is terminated in the vessel 1. A winch or anchor windloss 14 is typically provided on the main deck. In the vertical orientation of FIG. 2 a hawse pipe 8 extends from the chain locker 6 and opens at the top of the vessel. (The vertical orientation of the hawse pipe is not essential to the invention. The hawser chain seal assembly 10 to be described below, may as well be installed in series with a horizontally oriented hawse pipe as used when the anchor windlass is located on the machinery deck below the main deck.) A hawser chain 4 runs from the chain locker 6 through the hawse pipe 8 over an anchor windlass 14 and thence via an underwater fairlead 12 to the anchor. During extreme list conditions or heavy weather, seawater may enter the chain locker via the hawse pipe 8. In order to prevent such entry of seawater, a hawser chain seal assembly 10 is provided according to the invention in series with two aligned ends of the hawse pipe, 8 and 8'. During heavy weather or extreme listing of the vessel, the hawser chain seal assembly 10 may be actuated to close a packing element about the hawser chain to prevent entry of seawater into the chain locker.

Figure 3:
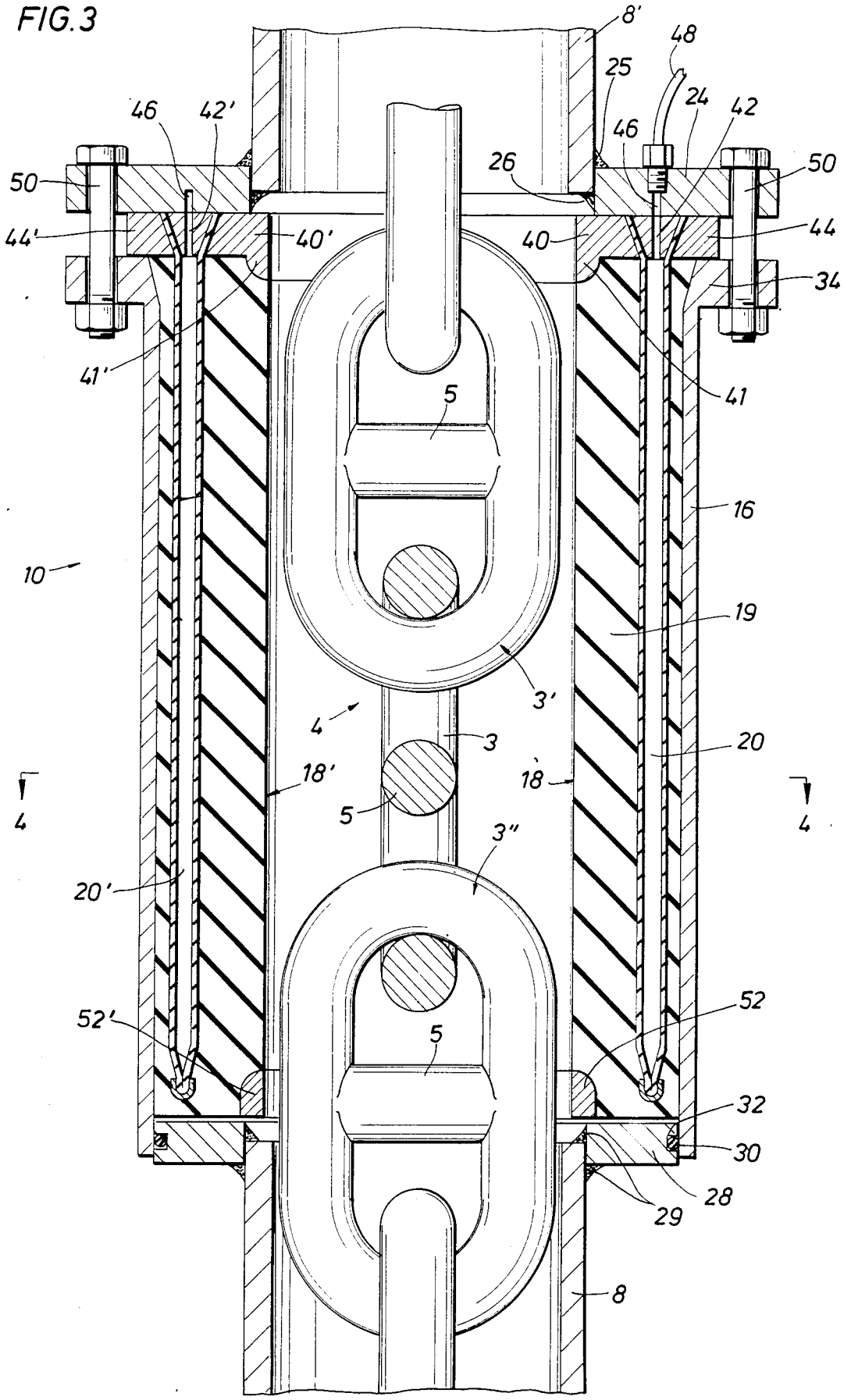
FIG. 3 shows in cross-section the hawser chain sealing assembly connected in series with two aligned sections of hawse pipe and further illustrating a hawse chain running through the hawse pipe and through the hawse chain seal assembly.

FIG. 3 shows in cross section the hawser chain seal assembly 10 according to the invention. As illustrated, a hawser chain 4 runs through aligned ends 8 and 8' of the hawse pipe. An outward annular flange 24 is secured to the hawse pipe 8' by means of welds 25, 26. Another outward flange 28 is secured to the hawse pipe 8 by means of welds 29. The ends of the hawse pipes 8 and 8' are axially aligned. The outward flange 28 includes a groove 32 provided on its outward peripheral surface. An "O" ring 30 is disposed in the groove 32 for sealingly engaging the interior surface of housing structure 16.

Housing structure 16 includes an outwardly facing flange 34 disposed opposite outward flange 24. Holes are disposed in outward flange 24 and outwardly facing flange 34 of housing structure 16 through which bolts 50 may be provided to fasten the housing 16 to the outward flange 24.

The sealing element of the hawser chain seal assembly 10 includes two semi-cylindrical elements 18 and 18', the construction of which may also be seen along a cross-section taken through line 4—4 and illustrated in FIG. 4. The sealing elements 18 and 18' cooperate to provide a complete cylindrical sealing element that is disposed about the chain 4. Preferably the sealing elements are formed of elastomeric material 19 in the shape of one-half of a cylinder cut by a plane through its longitudinal axis. Each sealing element 18, 18' has at least one, but preferably a plurality, of reinforced bladders 20, 20' extending longitudinally about the axis of the sealing element.

As best illustrated in FIG. 3 each of the sealing elements 18, 18' has secured at one of its ends a respective ring 40, 40' in the shape of one-half of a toroid. When the sealing elements 18, 18' are assembled, the one-half toroidal rings 40, 40' create a toroidal ring. The outer radius of the assembled toroid 40, 40' is greater than the outer radius of sealing elements 18, 18', forming an outer part 44, 44' which is clamped between the outwardly facing flange 34 of the housing structure 16 and the outward flange 24. As a result, when disposed about the chain 4, the sealing elements 18, 18' are secured within housing 16 by means of the clamping action of the outer parts 44, 44' between the flanges 24 and 34. As indicated above the flanges 24 and 34 are fastened by means of bolts 50 or other securing means.

The sealing elements 18, 18' further include protective rings 52, 52' which are also of the shape of one-half of a toroid and are secured to the elastomeric material 19 of the sealing elements 18 and 18' about the lower interior part of the elements. The lower protective rings 52, 52' serve to prevent the extrusion of elastomeric material during the closure of the sealing element about the bottom of the sealing element. Likewise, the one-half toroidal rings 40 and 40' are provided with lips 41, 41' which serve to prevent the extrusion of elastomeric material 19 to the upper part of the packing element when the sealing elements 18, 18' close about a chain 4 during closure.

A plurality of holes 42 are provided in the one-half toroidal rings 40, 40'. One hole is provided and aligned with each of the bladders 20, 20' disposed in the sealing elements 18, 18'. The holes are in communication with a manifold 46 in the outward flange 24 which communicates with a conduit 48 for the application of pressurized fluid for actuating the closure of the packing element.

Figure 5:
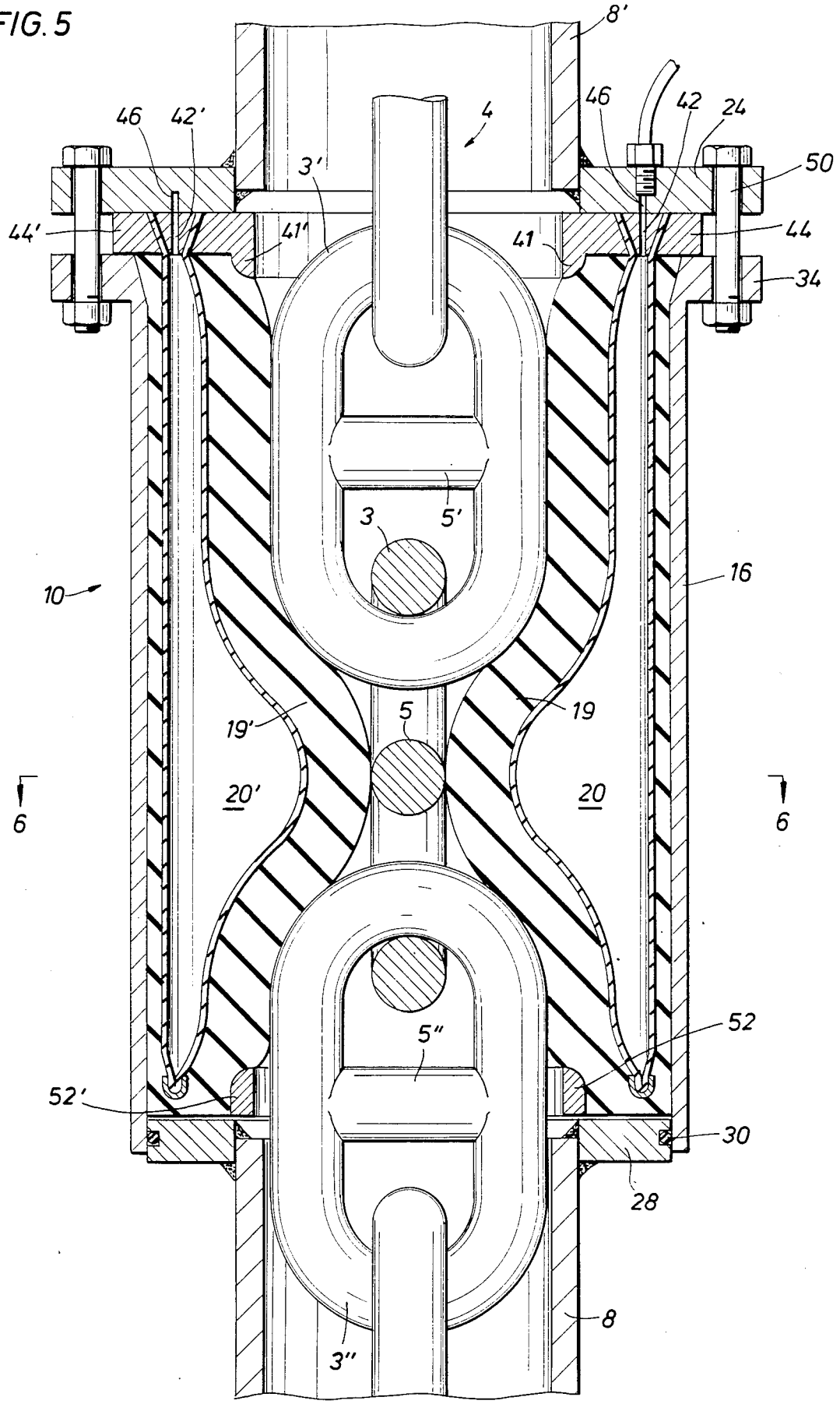
FIG. 5 illustrates the hawser seal assembly with its sealing element sealingly closed about a hawse chain running through the aligned ends of the hawse pipe and through the hawser chain seal assembly.

FIGS. 5 and 6 illustrate the condition of the hawser chain seal assembly 10 after it has been actuated for closure about the chain 4. The chain 4 preferably includes a plurality of links 3, 3', 3" each having a chain link stud 5 which tends to prevent knoting of the chain. As illustrated in FIGS. 5 and 6, the packing elements 18 and 18' have moved inwardly to seal about a link 3 and especially about the chain link stud 5.

FIG. 6 is a cross-sectional view through the line 6—6 through the chain link stud 5. The elastomeric material 19 from both the sealing elements 18, 18' has been moved inwardly by the application of pressurized fluid into the reinforced bladders 20 running longitudinally through the elastomeric material 19. The elastomeric material forms a complete seal between the housing 16 and about the chain link stud 5. The bladders 20 inflate sufficiently to move inwardly enough elastomeric material 19 to contact the stud 5 of link 3 thereby completely sealing the annulus of the hawse pipe 8 within the housing 16 of the hawser chain seal assembly 10. The bladders above and below the ends of the link 3 are shown to be only partially inflated in that not a great amount of elastomeric material need be moved opposite those bladders while the other bladders to the left and to the right of the chain link 3 are fully inflated because of the need to move a large quantity of elastomeric material into contact with the stud 5.

FIG. 5 further illustrates the effectiveness of the protective rings 52, 52' and lips 41, 41' of rings 40, 40' in preventing extrusion of elastomeric material downwardly and upwardly, respectively, during sealing about the stud 5 of link 3. The longitudinal length of the hawser chain seal assembly 10 is greater than the length of any link of the hawser chain 4 for insuring that during closure, a link and especially a chain link stud like stud 5 of link 3 may be positioned within the seal assembly so that the sealing elements 18, 18' may seal about the stud 5.

FIGS. 7A, 7B, 7C and 7D illustrate the method for installing the sealing elements 18, 18' about the hawser chain 4. FIG. 7A illustrates the housing structure 16 placed in a downward position telescopically over the hawse pipe 8. The "O" ring 30 of outward flange 28 (of FIGS. 3, 5) serves to seal the interior cylindrical surface of the housing 16 with the outer periphery of the flange 28. In the position illustrated in FIG. 7A, the hawse chain 4 running through the hawse pipe ends 8, 8' is exposed for placement of the first semi-cylindrical element 18' as illustrated in FIG. 7B. The other semi-cylindrical sealing element 18 is placed around the hawse chain 4 as illustrated in FIG. 7C. As illustrated in FIG. 7D, the housing structure 16 is moved upwardly until the outer parts 44' and 44 of the one-half toroidal rings of the packing elements 18', 18 are clamped between the flanges 24 and 34 thereby securing the packing elements within the housing. The process may be repeated by opening the housing structure 16 to remove worn packing elements and replaced with new ones in the sequences of FIGS. 7A to 7D.

As illustrated in FIGS. 4 and 6, the actuating bladders of the sealing elements 18 and 18' are uniformly circumferentially spaced about the central axis of the sealing element. Preferably the bladders are molded in the collapsed condition. The introduction of air or hydraulic pressure to the bladders causes them to expand and form a generally circular cross-section operably increasing their displaced volume. Since the sealing element is restricted by the outside diameter of the housing 16, the change in volume of the bladders causes the elastomeric material and the sealing element inside diameter to move inwardly forming a sealing engagement with the chain. As illustrated in FIG. 6, the sealing element may assume rapid changes in its cross-sectional shape in order to seal on irregular objects such as the hawser chain 4 illustrated in the drawings.

Various modifications and alterations in the described hawser chain seal assembly and the method for installation of its sealing element will be apparent to those skilled in the art from the foregoing description which does not depart from the spirit of the invention. The foregoing disclosure and description of the invention are illustrative and explanatory thereof and details of the illustrative embodiment may be made without departing from the spirit of the invention.

What is claimed is:

1. A hawser chain seal assembly adapted for sealing about a hawser chain, said chain extending through two axially aligned sections of hawser pipe, said assembly comprising, a housing means adapted for connecting said hawser pipe sections, said housing means movable to and from an open position for exposing said hawser chain extending through said hawser pipe sections and a closed position for longitudinally surrounding said hawser chain, a sealing element having at least two semi-cylindrical parts, each of said parts adapted for placement partially about said hawser chain when said housing means is in said open position, said sealing element being longitudinally disposed between said hawser chain and said housing means when said housing means is in said closed position, said semi-cylindrical parts of said sealing element each having at least one inflatable bladder, means for receiving pressurized fluid for application to said bladders of said sealing elements for causing said sealing elements to sealingly engage said hawser chain, and said housing means is connected between ends of the two axially aligned sections of hawser pipe and comprises, a first outward flange fastened to an end of a first section of hawser pipe, a second outward flange fastened to an end of a second section of hawser pipe, a sealing means disposed peripherally about an outwardly facing surface of said second flange, and a cylindrical housing structure for sealingly engaging said sealing means of said second flange and for fastening to said first outward flange, said housing structure being movable in one direction to an open position for providing external access to said hawser chain and being movable in the other direction to a closed position for fastening to said first outward flange.

2. The assembly of claim 1 wherein said sealing means is an "O" ring disposed in a peripheral groove about said outwardly facing surface of said second flange.

3. The assembly of claim 1 wherein said cylindrical housing structure includes an outwardly facing flange, and fastening means for fastening said outwardly facing flange to said first outward flange.

4. A hawser chain seal assembly adapted for sealing about a hawser chain, said chain extending through two axially aligned sections of hawser pipe, said assembly comprising, a housing means adapted for connecting said hawser pipe sections, said housing means movable to and from an open position for exposing said hawser chain extending through said hawser pipe sections and a closed position for longitudinally surrounding said hawser chain, a sealing element having at least two semi-cylindrical parts, each of said parts adapted for placement partially about said hawser chain when said housing means is in said open position, said sealing element being longitudinally disposed between said hawser chain and said housing means when said housing means is in said closed position, said semi-cylindrical parts of said sealing element each having a plurality of inflatable bladders molded therein, means for receiving pressurized fluid for application to said bladders of said sealing elements for causing said sealing elements to sealingly engage said hawser chain, said semi-cylindrical sealing parts are each formed of elastomeric material in the shape of one-half of a cylinder cut by a plane through its longitudinal axis and when placed about said hawser chain cooperate to form a cylindrical packing element for sealing about said hawser chain 5. The assembly of claim 4 wherein when said cylindrical packing element is in place about said hawser chain and said housing is in said closed position, application of pressurized fluid to said inflatable bladders causes elastomeric material to be restricted by the housing on its outer diameter and to move inwardly forming sealing engagement with said hawser chain.

6. The assembly of claim 1 wherein each one-half cylinder of elastomeric material further includes a ring of one-half toroidal shape secured to its top end, said rings having a plurality of holes provided therein, each of said holes communicating solely with one of the bladders in each one-half cylinder to which it is secured, said rings having an outer radius greater than the outer radius of the assembled one-half cylinder operably creating an outer flange extending beyond the cylindrical walls of elastomeric material, said outer flange being clamped between said outwardly facing flange of said cylindrical housing structure and said first outward flange when said cylindrical housing structure flange is fastened to said first outward flange, and manifold means disposed in said first outward flange for providing fluid communication with each of said bladders in said two one-half cylinders when said one-half cylinders are disposed about said hawser chain via said holes in said rings.

7. The assembly of claim 1 wherein said fastening means comprises a plurality of bolts through aligned holes in said outer flange and said cylindrical housing structure outwardly facing flange.

* * * * *